US006036485A

United States Patent [19]

Benedetti

[11] Patent Number: 6,036,485

[45] Date of Patent: Mar. 14, 2000

[54] ANNEALING FURNACE

[75] Inventor: Gianpietro Benedetti, Campoformido-Udine, Italy

[73] Assignee: Danieli Corporation, Cranberry Twp., Pa.

[21] Appl. No.: 09/315,847

[22] Filed: May 21, 1999

[51] Int. Cl.[7] ..... F27B 9/24

[52] U.S. Cl. ..... 432/122; 432/123

[58] Field of Search ..... 432/122, 123, 432/126, 234, 235, 58, 59

[56] References Cited

U.S. PATENT DOCUMENTS

| | | | |
|---|---|---|---|
| 1,407,192 | 2/1922 | Steigner . | |
| 1,712,205 | 5/1929 | Good . | |
| 1,738,038 | 12/1929 | Cope . | |
| 2,139,067 | 12/1938 | Boax . | |
| 2,237,659 | 4/1941 | Edwards . | |
| 2,748,537 | 6/1956 | Pasotti et al. . | |
| 3,677,394 | 7/1972 | Bloom | 198/127 |
| 3,827,267 | 8/1974 | Lowderman et al. | 72/69 |
| 3,939,296 | 2/1976 | Burger et al. | 432/260 |
| 4,102,449 | 7/1978 | Shufran | 432/122 |
| 4,238,122 | 12/1980 | Snyder et al. | 432/23 |
| 4,585,411 | 4/1986 | Bocci et al. | 432/122 |
| 5,393,039 | 2/1995 | Smith | 266/261 |
| 5,588,828 | 12/1996 | Nagata et al. | 432/59 |

*Primary Examiner*—Denise L. Ferensic
*Assistant Examiner*—Gregory A. Wilson
*Attorney, Agent, or Firm*—Armstrong, Westerman Hattori, McLeland & Naughton

[57] ABSTRACT

The method and apparatus is directed toward an annealing furnace and a method of using the same where the annealing furnaces includes a layer forming apparatus suitable to create layers of metal product; an insulated housing having an interior cavity formed by a roof, a floor, opposing side walls extending the annealing furnace length, opposing side walls extending the annealing furnace width, said insulated housing also having an entrance for introducing metal product and exit for discharging metal product; a heating means in the interior cavity for heat treating metal product; transportation device suitable to convey the metal product in form of layers from the chamber entrance to its exit, whereas to guarantee a stay time inside said furnace suitable for obtaining a required heat treatment; and a discharging apparatus suitable to break up the product layers.

5 Claims, 8 Drawing Sheets

ANNEALING FURNACE

CROSS REFERENCE TO RELATED APPLICATIONS

This application is related to four co-pending applications: "Integrated Plant for the Production of Rolled Stock" filed even date herewith; "Automated Rolling Mill Administration System" filed even date herewith; "Method and Apparatus for In-Line Heat Treatment of Hot Rolled Stock" filed even date herewith and "Coil Area for In-Line Treatment of Rolled Products" filed even date herewith which applications are assigned to the assignee of the present application and incorporated by reference herein.

FIELD OF THE INVENTION

The present invention relates to in-line continuous annealing furnaces for long metal product such as rods and bars.

BACKGROUND OF THE INVENTION

The purpose of heat treatment of metal product is to develop the full effects of the various elements in metal product, such as steel, as related to desired properties, through structural or phase changes. Rods and bars vary in hardness and microstructure in relation to the chemical composition of the metal and, therefore usually require some form of heat treatment to obtain a physical condition best suited for the final product. Low-and medium-carbon bars often are used in the as-rolled condition, but higher carbon steels and most alloy steels require heat treatment. This treatment consists of some form of annealing, normalizing, or quenching and tempering or a combination of treatments. By thermal treatment, it is possible to obtain the transformation of a particular metal, like a particular steel, to obtain the desired mechanical properties.

The annealing process is a function of time and temperature. The time and temperature depend on the grade and quality of metal being produced. Annealing and spheroidizing annealing of rod and bar is accomplished using one of two basic furnace designs. The first type of design is called "batch" heat-treatment, and as the name implies, the product is thermally treated as a unit or batch. The second design is termed "continuous type furnaces," and these are usually known for higher productivity and improved uniformity of treatment of the metal product. The invention herein is a continuous annealing furnace. The furnace, however, can be used in "batch" modality, for instance when working with a limited productivity on the line for the heat treatment using the annealing furnace or on the bar line in general.

Once a type of thermal treatment has been established for a given product, the treatment time is relatively fixed. The capacity of a furnace for metal product is determined by the charge weight and the cycle rate. Usually, both the charge weight and the cycle rate are fixed for a particular type of thermal treatment. Annealing is characterized by faster cycle rates and lower product ductility, while spheroidization is a slower process and produces higher product ductility. Total furnace capacity is therefore the result of the mix of annealing and single spheroidizing cycles. As the volume of spheroidization increases, the furnace capacity decreases.

Some capacity improvement has been obtained by the manipulation of the temperatures within the process, allowing for a shorter cycle time. Once optimum time and temperature relationships have been established for a particular thermal treatment, rates of transporting the metal product through the furnace can generally be considered as fixed.

The typical annealing process for rods and bars of round, square, and rectangular shapes is as follows: Conventionally, bars of round, square and hexagonal cross sections varying from 15 mm to 100 mm in diameter and from 3 mm to 100 mm thick and up to 100 mm wide for rectangular cross sections may be treated in such a furnace by being heated in a range of approximately 300° C. to 1100° C. while being conveyed through the annealing furnace. There exists a need for conveyors capable of conveying metal product of a variety of cross sections such as squares, rounds, rectangles, etc. without particular adaptation for each and a need for continuous conveyors capable of delivering metal product aligned with the next in-line process.

Precise control of the temperature of the rod or bar during the annealing process requires the temperature profile in the annealing furnace to be uniform over the volume enclosing the metal product. In larger conventional box furnaces such uniform temperature profiles are difficult to achieve and may exist in only a small fraction of the total volume of the heated furnace chamber.

U.S. Pat. No. 2,139,067 issued to J. J. Boax in 1938 describes a heating furnace. The heating furnace is arranged to receive articles in groups or batches and to move the received batch through the heating chamber at a speed correlated to the temperature so that the batch of articles will be delivered at the exit of the chamber at the desired temperature. This system is designed primarily for batch handling of metal product, the heating of the metal bars on the batch conveyor may not be even and batch delivery of metal product to the furnace requires either that the furnace to be off-line or the furnace have some type of hopper to collect articles in batch.

Many prior art annealing furnaces are off-line annealing furnaces. Because of the size and time requirements of prior art annealing furnaces they are usually not included in-line on a steel making line, for example. The prior art method of thermal treatment of metal product in off-line processes normally requires long cycle times, which leads to very low productivity levels, high heat treatment costs and less energy savings.

The present invention relates to an in-line continuous furnace for thermal treating long rods and bars which is flexible in function and efficient in operation. The present invention overcomes the disadvantages of the prior art and can obtain the following cycle times in a steel rolling line: for spheroidizing-annealing steel product can be treated for one to two hours at 680 to 720° C.; for workability annealing steel product can be treated for 30 to 40 minutes at 650° C. and for shearability annealing steel product may be treated for 30 to 40 minutes at 650° C.

OBJECTS OF THE INVENTION

It is the principal object of the invention to provide an in-line continuous annealing furnace that more efficiently uses land, capital and resources as compared to conventional annealing furnaces.

It is an object of the present invention to provide an annealing furnace that significantly reduces horizontal the distance between the entrance for rolling stock and the exit for rolling stock.

It is another object of the present invention to provide an annealing furnace that reduces energy consumption because it is in-line with other process steps and thus adaptable to accept preheated bars or rods.

It is still another object of the present invention to provide an annealing furnace with an insulated chamber which can maintain a controlled atmosphere in order to limit the decarbonation of metal product during heat treatment.

It is yet another object of the present invention to provide an annealing furnace that is flexible in operation, that can accommodate different annealing profiles characterized by different temperatures and times of annealing.

It is a further object of the present invention to provide an annealing furnace so constructed and arranged that during movement through the furnace each metal product occupies positions such that the transfer of heat to and/or from it is substantially unaffected by the positioning of other articles transversing the furnace.

It is still a further object of the present invention to provide a furnace with improved means for traversing articles through the furnace.

Other objects, features and advantages of the present invention will become apparent from the following detailed description taken in conjunction with the accompanying drawings.

SUMMARY OF THE INVENTION

The method and apparatus is directed toward an annealing furnace and a method of using the same where the annealing furnaces includes a layer forming apparatus suitable to create layers of metal product; an insulated housing having an interior cavity formed by a roof, a floor, opposing side walls extending the annealing furnace length, opposing side walls extending the annealing furnace width, said insulated housing also having an entrance for introducing metal product and exit for discharging metal product; a heating means in the interior cavity for heat treating metal product; transportation device suitable to convey the metal product in form of layers from the chamber entrance to its exit, whereas to guarantee a stay time inside said furnace suitable for obtaining a required heat treatment; and a discharging apparatus suitable to break up the product layers.

DETAILED DESCRIPTION OF THE PREFERRED EMBODIMENT

Figure 1:
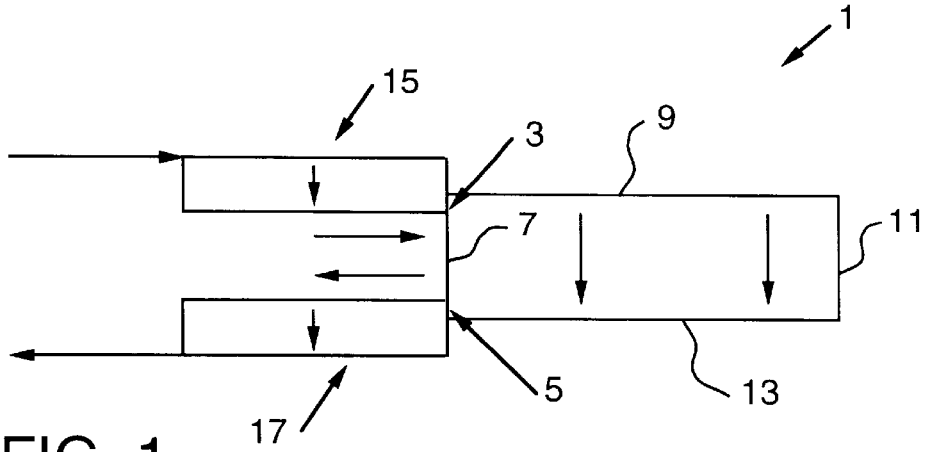
FIG. 1 is a schematic view of a product layer forming apparatus, an annealing furnace, and a product layer discharging apparatus of the present invention.

The principal purposes of annealing are to relieve cooling stresses induced by cold or hot working, and to soften the steel. It may involve only a subcritical heating to relieve stresses, to recrystallize cold-worked material, or to spheroidize the carbides or it may involve heating above the critical temperature with subsequent transformation to pearlite or directly to a spheroidized structure on cooling.

The most common heat treatments performed in furnaces are annealing, normalizing, spheroidizing, hardening, tempering, carburizing and stress relieving. Heat-treating furnaces are seldom designed for temperatures in excess of 1095° C. (2000° F.), and generally are operated in the 425° to 870° C. (800° to 1600° F.) range. Attention in design is directed toward procuring uniform temperature distribution in the working chamber of the furnace. The position and method of heat application, and the circulation of gases in the furnace are therefore important.

Also spacing the charge in order to attain the most-efficient flow of heat around the stock is important. In all heat-treating layouts, special consideration is given to providing sufficient furnace capacity to maintain the desired time-temperature relation of the treatment. Furnaces forced beyond their normal capacity can yield an erratic and non-uniform product. In heat treating steel, the rate of heat transfer to the surface is usually low in order that each individual piece, as well as all pieces in the furnace, may be brought up uniformly to the required temperature level.

Long bars may enter the annealing furnace in one of several metallurgical states. Preferably, long metal bars will enter the annealing furnace of the present invention after being thermally treated in a finishing area directly upstream from the annealing furnace. The finishing area of the present invention is for thermal treatment of long metal bars after a hot rolling process.

In the processing line of the present invention, the annealing furnace is located directly downstream from the finishing area for hot rolled stock. An in-line annealing furnace of the present invention is advantageous for several reasons. Direct transfer of metal bars from the finishing area to the annealing furnace eliminates off-line transportation and additional unloading and loading necessary for annealing of metal bars off-line from the hot rolling process. By reducing the handling time and number of physical transfers of the metal bar, the overall operational costs are lower because the reduction in the number of bar transfers lowers the energy costs and labor costs.

Further, by directly transferring metal bar from the finishing area of the rolling process into the annealing furnace, the metal bars enter the annealing furnace at the temperature at which they exit the finishing area. This reduces heat loss and saves energy costs by conserving the heat input from upstream processes.

By the conservation of space and energy the in-line annealing furnace of the present invention can produce annealed metal bar with less time and energy than annealing furnaces treating metal bars off-line from the hot rolling process. Space is conserved by reducing the distance between the entrance and exit of the annealing furnace.

The in-line annealing furnace of the present invention can achieve the following cycle times for metal product, particularly steel product: for spheroidizing-annealing steel product can be treated for one to two hours at 680 to 720° C.; for workability annealing steel product can be treated for 30 to 40 minutes at 650° C. and for shearability annealing steel product may be treated for 30 to 40 minutes at 650° C. The specific time and temperature of annealing will depend on the type of steel being processed. The time and temperature will also be dependent on the atmosphere in the annealing furnace.

The annealing furnace of the present invention is a continuous annealing furnace downstream from a heat treatment apparatus and upstream from a finishing area having metal product finishing equipment. The process line in which the annealing furnace is located is more fully described in the following four co-pending applications: "Integrated Plant for the Production of Rolled Stock," "Automated Rolling Mill Administration System," "Method and Apparatus for In-Line Heat Treatment of Hot Rolled Stock" and "Coil Area for In-Line Treatment of Rolled Products" which applications are assigned to the assignee of the present application and incorporated by reference herein. The annealing furnace of the present invention handles rolled bar, broken down metal slabs, tubular product, wire product or other metal elongated shaped product. The terms "metal product" or "product" will be used to describe generally all possible metal elongated shaped products which are processed in the apparatus of the present invention. Generally the metal elongated shaped products processed in the annealing furnace of the present invention will have a diameter or width of 10 mm or greater.

In the preferred embodiment, the annealing furnace of the present invention is associated with an upstream product layer forming apparatus and a downstream product layer discharging apparatus. The product layer forming apparatus and the product layer discharging apparatus facilitate the loading and unloading of a layer of metal product. A product layer or layer of metal product is a plurality of individual metal products, like metal bars, slabs, tubes or wires, which comprise a group or "layer." The number of metal products in a layer depends on the diameter or width of each metal product. The formation of layers of metal product is the formation of a group of two or more metal products by accumulating individual metal products into a group or layer and then handling each layer as a unit. The processing of a layer of metal product at one time increases the processing capacity of the equipment as compared to equipment that can only handle individual metal product one at a time.

FIG. 1 is a schematic view of a configuration of the annealing furnace, product layer forming apparatus and product layer discharging apparatus of the present invention. An annealing furnace 1 has a product entrance 3 and a product exit 5. Annealing furnace 1 has four side walls 7, 9, 11 and 13 and a roof (not shown) and a floor (not shown). Product entrance 3 and product exit 5 are located approximate opposing ends of a same sidewall 7 of annealing furnace 1.

Associated with product entrance 3 is a product layer forming apparatus 15 and associated with product exit 5 is a product discharging apparatus 17. Product layer forming apparatus 15 creates layers of metal product and introduces the so formed layers or groups of metal product into the annealing furnace 1 at the product entrance 3. Annealing furnace 1 processes one or more layers of metal product simultaneously and discharges one or more product layers to the product layer discharging apparatus 17. The product layer discharging apparatus 17 transports one or more layers of metal product away from and downstream the annealing furnace 1. The directional arrows of FIG. 1 illustrate the flow direction of metal product.

Figure 2:
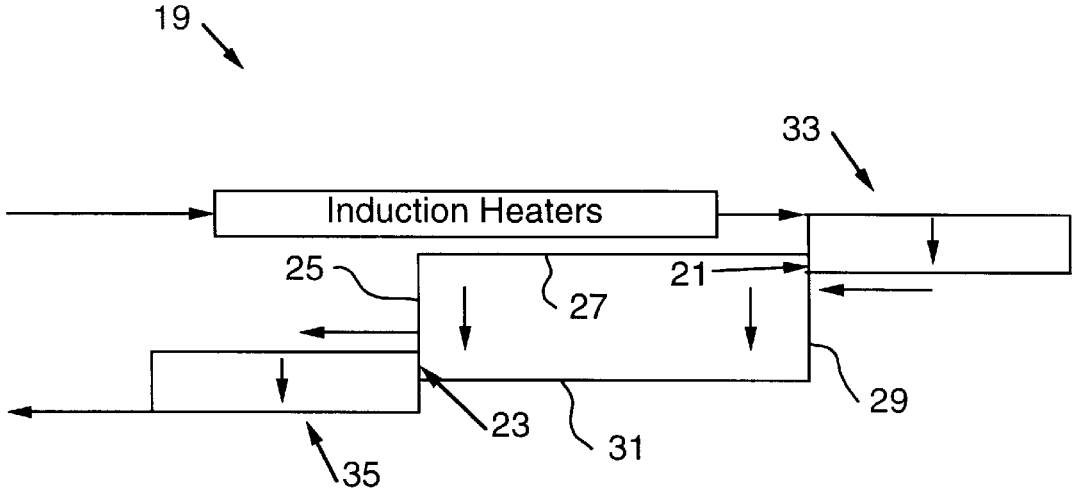
FIG. 2 is a schematic view of another arrangement of a product layer forming apparatus, an annealing furnace, and a product layer discharging apparatus of the present invention.

FIG. 2 is a schematic view of another configuration of the annealing furnace, product layer forming apparatus and product layer discharging apparatus of the present invention. An annealing furnace 19 has a product entrance 21 and a product exit 23. Annealing furnace 19 has four side walls 25, 27, 29 and 31 and a roof (not shown) and a floor (not shown). Product entrance 21 and product exit 23 are located on opposing sidewalls 25 and 29. Metal product enters annealing furnace 19 at sidewall 29 and exits annealing furnace 19 at opposite sidewall 25. Other possible configurations of the annealing furnace 19, a product layer forming apparatus 33 and product layer discharging apparatus 35 of the present invention are possible and depend on the flow of materials through each apparatus and the annealing furnace. The directional arrows of FIG. 2 illustrate the flow direction of metal product.

In the preferred embodiment, the annealing furnace of the present invention will be preceded by a product layer forming apparatus and will be succeeded by a product layer discharging apparatus. These two devices facilitate the substantially continuous movement of metal product in the metal process line. In another embodiment, the layer forming and charging devices as well as the layer discharging devices for the annealing furnace can be located inside the annealing furnace itself, particularly in the one-level annealing furnace (FIG. 9), as shall be described further, where it is not necessary to perform vertical handling of the layers to convey them to different levels.

Figure 3:
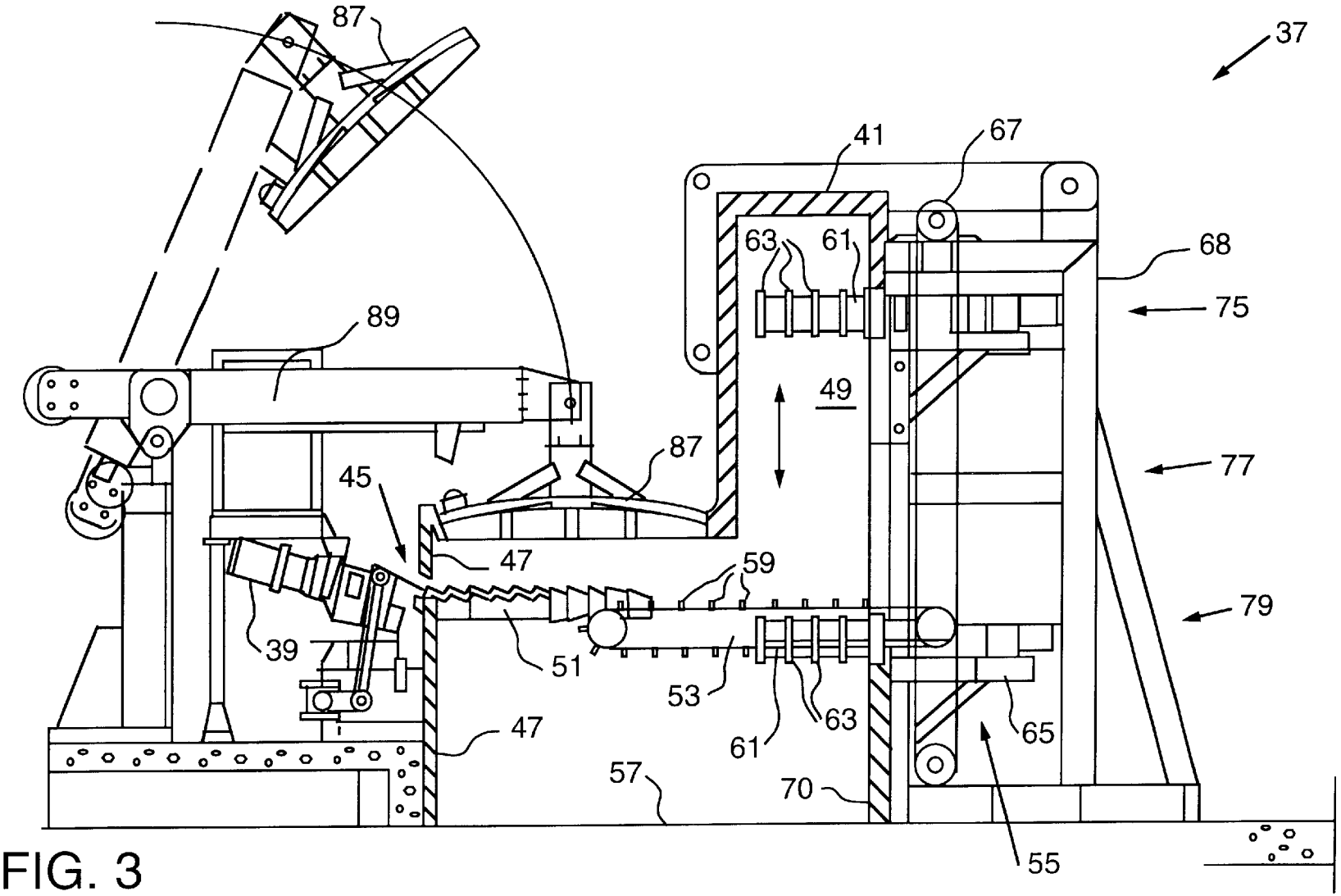
FIG. 3 is a schematic cross sectional view of a product layer forming apparatus of the present invention.

FIG. 3 is a cross-sectional view of a product layer forming apparatus 37 of the present invention. Product layer forming apparatus 37 includes a loader 39, to load metal product, an insulated housing 41, and a series of transportation means to both transport metal product inside the product layer forming apparatus 37 and to form product layers for entry in to the annealing furnace 43, shown in FIG. 4.

Metal product exits the finishing area of the process line and directly enters loader 39, as illustrated in FIG. 3. Loader 39 is upstream from product layer forming apparatus 37. Loader 39 is designed to handle elongated metal product including, but not limited to elongated metal product 70 m long. Longer metal product up to loom can be handled by loader 39. There can be more than one loader 39 longitudinally spaced along the length of the insulated housing 41 of the product layer forming apparatus 37. If two loaders 39 are used, for example, each loader 39 could be located approximate opposing ends of the insulated housing 41 to support opposing ends of the metal product.

Loader 39 performs the material handling steps of receiving metal product and loading metal product into product layer forming apparatus 37 through an opening 45 in a sidewall 47. Loader 39 receives product from a transportation means (not shown) which transports the metal product from the finishing area into loader 39. Loader 39 may also be able to receive more than one metal product at a time in order to facilitate continuous line operation without slowing or stopping the movement of the product through the process line. After receiving metal product, loader 39, adjacent opening 45 in sidewall 47, loads metal product into product layer forming apparatus 37.

Figure 4:
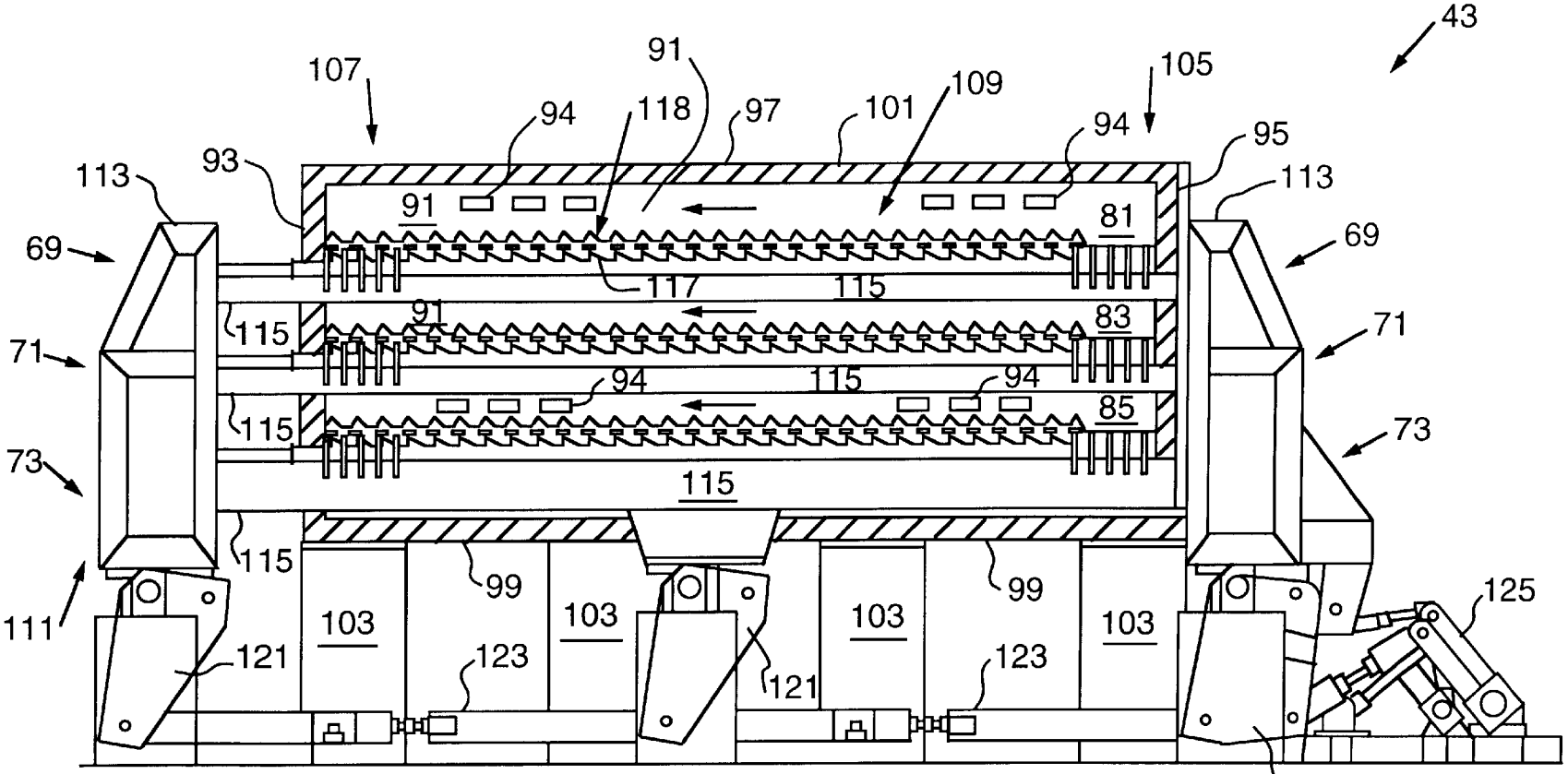
FIG. 4 is a schematic view of an annealing furnace of the present invention.

The product layer forming apparatus 37 is an insulated area for forming product layers or product groups prior to entrance into the annealing furnace 43, shown in FIG. 4. Product layers may be formed in a thermally controlled environment so the heat of the unquenched metal product is maintained until the metal product reaches the annealing furnace 43. A thermally controlled or insulated environment is particularly useful when spheroidizing metal product. The thermal treatment of metal product in the product layer forming apparatus 37 depends on the desired metallurgical properties to be achieved.

The product layer forming apparatus 37, preceding the annealing furnace 43 shown in FIG. 4, is an area for accumulating a group of two or more metal products. Individual metal products are loaded by loader 39 into product layer forming apparatus 37 and formed into layers of metal product. In the present invention, metal products are loaded in layers directly into the annealing furnace 43 and processed as layers.

Product layer forming apparatus 37 may also be a thermal treater for metal products prior to entering the annealing furnace 43. Product layer forming apparatus 37 of the present invention can include a means for thermally treating metal product in an interior cavity 49 of the product layer forming apparatus 37. Means for thermally treating includes heating means such as gas burners, radiating pipes, induction coils and the like. The insulated housing 41 is preferably made of insulated brick. Insulated brick is ideal for retaining heat in the interior cavity 49 of the product layer forming apparatus 37.

In direct-fired furnaces, open burners can be used either in the furnace or they may be installed outside the work-heating chamber in the path of an external fan which circulates volumes of gases through the furnace. Resistance-type heating elements, which can be imbedded in the furnace refractory lining or suspended from heat-resisting hangers, radiate heat to the furnace charge.

The opening 45 extends longitudinally the length of product layer forming apparatus 37 so elongated metal product may be charged without substantial bending. The opening 45 may be protected by a barrier or thermal seal, such as a flame or heat curtain, in order to minimize heat transfer between the interior cavity 49 and the exterior.

Metal products charged into product layer forming apparatus 37 are received by at least one transportation and product layer forming means. The transportation and product layer forming means apparatus will depend on the design of the annealing furnace. Different annealing furnaces have different loading or charging areas and thus require a transportation and product layer forming means that can form product layers and transport the product layers to the charging area.

In the preferred embodiment shown in FIG. 3, metal product charged into the opening 45 is received by an individual product transportation device 51 which is followed by a product layer forming device 53 which is followed by a product layer transportation device 55, which charges the metal layer to the annealing furnace 43. The individual product transportation device 51 is, in the preferred embodiment, a walking beam conveyor. The individual product transportation device 51 transports metal product individually and substantially horizontally from opening 45 to product layer forming device 53. The individual product transportation device 51 is designed to handle elongated metal product and is secured to at least the floor 57 or sidewall 47 of the insulated housing 41.

Metal product can be transferred from the individual product transportation device 51 to the product layer forming device 53 by dropping or falling from the end of the individual product transportation device 51 onto the surface of the product layer forming device 53. The product layer forming device 53 moves substantially horizontally.

The product layer forming device 53 is preferably an indexing transportation means for accumulating individual metal products received from individual product transportation device 51. In FIG. 3, product layer forming device 53 is an endless conveyor with flanges 59 longitudinally spaced to create recesses for accumulating a plurality of individual metal products. The product layer forming device 53 can be indexed one position after the accumulation of a plurality of individual metal product in a first recess forming a layer of metal product. Indexing will position a second recess approximate the individual product transportation device 51 so a new layer of metal product can be formed in the second recess. Product layer forming device 53 transports formed layers of metal product to the product layer transportation device 55. Product layer forming device 53 is secured to at least one or both of the floor 57 and sidewall 47 of the insulated housing 41.

The product layer transportation device 55 transports formed layers of metal product to the entrance of the annealing furnace 43, as shown in FIG. 4. The product layer transportation device 55 includes a support member 61 for supporting a plurality of layers of elongated metal product. Support member 61 is positioned substantially horizontally. Further, the support member 61 has a plurality of longitudinally spaced rings 63 which create recesses therebetween for separating a plurality of layers of metal product. In FIG. 3, four layers separated by rings 63 can be supported on support member 61. The product layer transportation device 55 also includes a vertical lifting member 65 and drive means 67. The drive means 67 of the product layer transportation device 55 can be housed on a frame 68 outside the interior cavity 49 of product layer forming apparatus 37, as shown in FIG. 3. Frame 68 is attached to a sidewall 70 of insulated housing 41.

In the embodiment shown in. FIG. 4, the annealing furnace 43 has three levels 69, 71, and 73 for handling elongated metal product. Therefore, the product layer transportation device 55 of FIG. 3 has three positions 75, 77, and 79. The three positions 75, 77, and 79 correspond to the entrances 81, 83, and 85 on the three levels 69, 71, and 73 of annealing furnace 43. (FIG. 4) The product layer transportation device 55 can be elevated and stopped at the three positions 75, 77, and 79 by the drive means 67. The arrow in FIG. 3 indicates the directions of motion of the product layer transportation device 55.

In the preferred embodiment, the support member 61 is cylindrical and rotatable such that a layer of metal product supported thereon can be charged to the annealing furnace 43 by the rotation of the support member 61.

The product layer transportation device 55 may be a single device designed to handle elongated metal product or it may be a plurality of devices spaced longitudinally along the length of the product layer forming apparatus 37. If a plurality of devices are used, the movement of the plurality of support members 61 is coordinated to allow for the transportation of product layers in at a substantially horizontal angle.

For purposes of inspection, treatment and machine repair the individual product transportation device 51 and the product layer forming device 53 can be located under a pivotally retractable hood 87. The pivotally retractable hood 87 may be removed so that the metal products may be inspected. A pivotally retractable hood 87 connected to a pivot arm 89 is a preferred design. A pivotally retractable hood 87 is not necessary for the operation of the layer forming apparatus 37. The dashed-line pivot arm 89 shows the retracted position of pivot arm 89. The arched line shows the path of motion of pivot arm 89.

As illustrated in FIG. 4, annealing furnace 43 has an interior cavity 91 formed by opposing sidewalls 93 and 95, a roof 97, a floor 99 a back wall (not shown) and a front wall (not shown). All walls, roof 97 and floor 99 are made of an insulating material 101, like insulated brick. Annealing furnace 43 is supported by foundation members 103. Annealing furnace 43 has a product entrance side 105 and a product exit side 107.

Annealing furnace 43 has a heating means 94, which can be for example radiation pipes, induction coils or gas burners. The heating means 94 can be located along all the walls and the roof 97 and floor 99 in the interior cavity 91 of the annealing furnace 43.

On each level 69, 71 and 73 is a transportation means 109 for transporting and supporting a layer of metal product from the entrance side 105 to the exit side 107 of the annealing furnace 43. During the time in which a layer of metal product is transported, the layer is subject to heat treatment in order to achieve the desired metallurgical properties of the product layer.

In the preferred embodiment, the transportation means 109 is a substantially horizontal walking beam conveyor. The annealing furnace 43 has a coordinated transportation device 111 which provides layer transportation from the entrance side 105 to the exit side 107 on all three levels 69, 71 and 73. The coordinated transportation device 111 includes at least two movable support means 113 in sets of opposing pairs, two of which are shown in FIG. 4 which illustrates one end of annealing furnace 43; a plurality of connection beams 115 connecting the movable support means 113; a plurality of layer moving surfaces 117 connected to the connection beams 115; a plurality of layer support surfaces 119 fixed with respect to the annealing furnace 43; an intermediate device 121 connected to the base of each movable support means 113; at least one actuating link 123 connecting intermediate devices 121 under a pair of movable support means 113 and at least one drive means 125 connected to intermediate device 121 on at least one side of the annealing furnace 43.

The coordinated transportation device 111 is an efficient means for transporting layers of metal product from the entrance side 105 to the exit side 107 of the annealing furnace 43. One advantage of the coordinated transportation device 111 is that a single transportation device serves to transport a plurality of product layers throughout the interior cavity 91 of annealing furnace 43. The coordinated transportation device 111 works as follows: at least one layer of metal product is charged to entrance side 105 from support member 61 of the product layer transportation device 55. At least one layer of metal product is charged through an opening (not shown) in the front wall of annealing furnace 43. The opening may have a barrier seal or flame or heat curtain in order to prevent the transfer of heat from interior cavity 91 of annealing furnace 43 to the exterior. The layer of metal product is charged into annealing furnace 43 so that it is completely inside the interior cavity 91.

A layer of metal product may be charged to any one of the three levels 69, 71 and 73. The coordinated transportation device 111 can transport a plurality of product layers on each of the three levels 69, 71 and 73. Once inside annealing furnace 43, the product layer is supported on the plurality of layer support surfaces 119 fixed with respect to the annealing furnace 43.

The product layer is moved or transported from entrance side 105 to exit side 107 by the vertical and lateral motion of the plurality of layer moving surfaces 117. The plurality of layer moving surfaces 117 are in between each of the plurality of layer support surfaces 119 and each of the plurality of layer moving surfaces 117 is connected to each of the plurality of connection beams 115 extending between a pair of opposing movable support means 113. By the vertical and lateral motion of the plurality of layer moving surfaces 117 the product layer is transported from the entrance side 105 to the exit side 107.

The vertical and lateral motion of the plurality of layer moving surfaces 117 is generated by the action of the drive means 125 on the intermediate device 121 on at least one side of the annealing furnace 43. The path of movement of the plurality of layer moving surfaces 117 is the same as the path of movement of the intermediate devices 121. Intermediate device 121 has a substantially circular shaped motion. Drive means 125 imparts motion to at least one intermediate device 121 which is associated with movable support means 113. At least one intermediate device 121 is also associated with another intermediate device 121 by connection via the actuating link 123. Actuating link 123 may also be connected at its longitudinal mid-point to another intermediate device 121 further connected to one of a plurality of connection beams 115. Therefore, the motion imparted by drive means 125 is imparted directly to a first intermediate device 121 and a second intermediate device 121 connected to the first intermediate device 121 by actuating link 123.

The result is the coordinated motion of two movable support means 113 connected by a plurality of connection beams 115 and the actuating link 123 associated with the intermediate devices 121. The movable support means 113 move in response to the motion of the intermediate devices 121 which causes a walking beam type transportation system.

The coordinated transportation device 111 creates an efficient transportation means for annealing furnace 43. Once the product layer reaches the exit side 107, the product layer is discharged from annealing furnace 43 through an opening (not shown) in the back wall. Simultaneous with the discharging of one product layer is the charging of a new product layer into annealing furnace 43.

Figure 5:
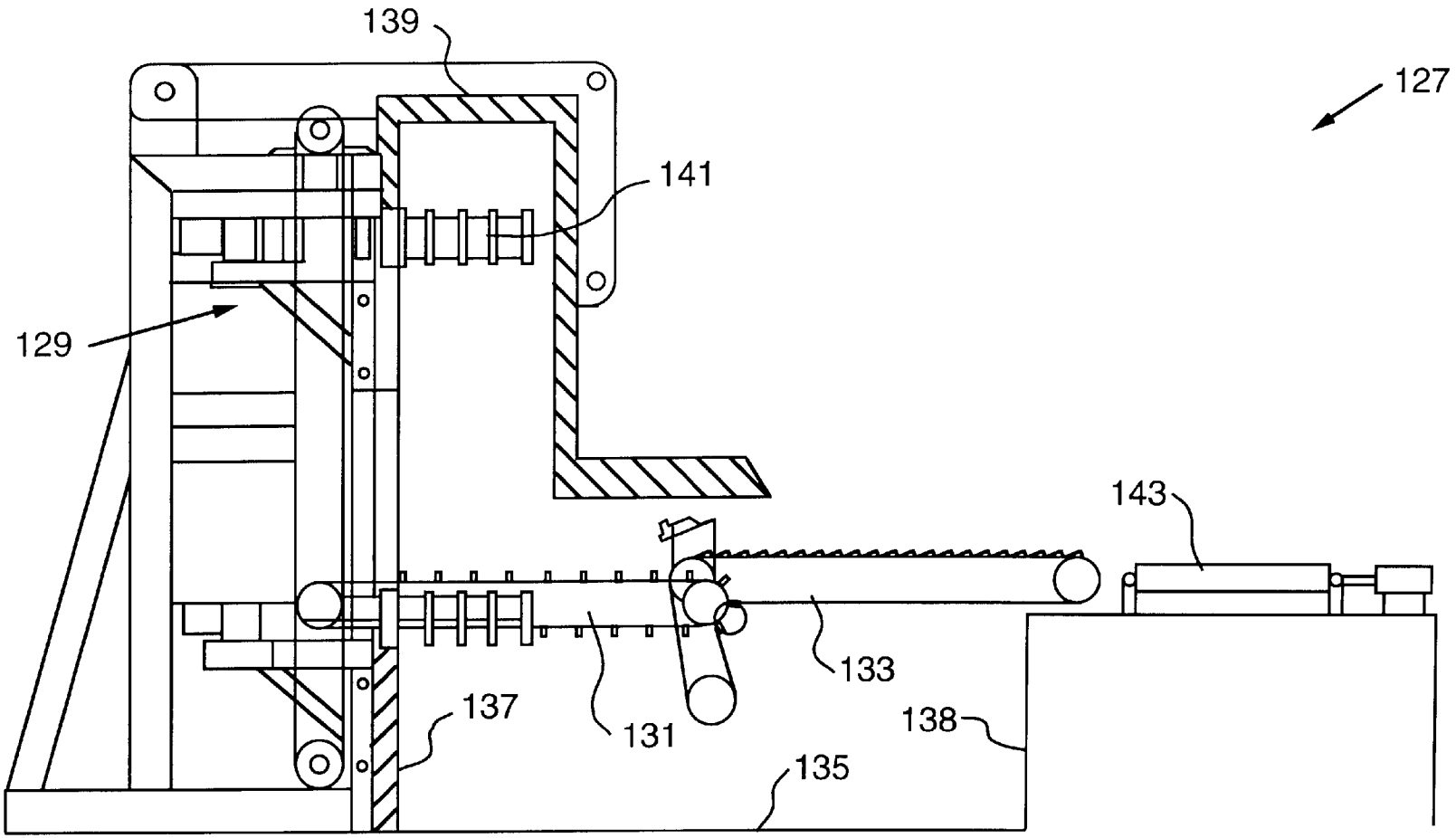
FIG. 5 is a schematic view of an product layer discharging apparatus of the present invention.

The product layer discharging apparatus 127, illustrated in FIG. 5, is similar to product layer forming apparatus 37 of FIG. 3. In brief, product layer discharging apparatus 127 has a vertical product layer transportation device 129 followed by a horizontal product layer transportation device 131 which is followed by an individual metal product transportation device 133. All of the transportation devices are supported by at least the floor 135 and the sidewalls 137 and 138 of product layer discharging apparatus 127. Product layer discharging apparatus 127 has an insulated housing 139 similar to product layer forming apparatus 37.

Product layer discharging apparatus 127 works the same as product layer forming apparatus 37 except the transportation steps occur in the reverse order. For example, the product layer is discharged from annealing furnace 43 to support members 141 of the vertical product layer transportation device 129. In the preferred operation, the product layers are discharged from the top level first, followed by the second level, followed by the third level, etc. The product layer is then transferred to the horizontal product layer transportation device 131 and is transported away from and downstream annealing furnace 43. The individual product transportation device 133 breaks up the product layers by transporting individual metal product one at a time downstream from annealing furnace 43. The individual metal product is transported to a roller table 143.

Product layer discharging apparatus 127 has an insulated housing 139 in order to control the cooling rate of the metal product layers. The product layer discharging apparatus 127 limits the cooling of the metal layers to assure their straightness. The desired metallurgical properties may be achieved by controlling the cooling rate after annealing. The effect of a heat-treating operation on the surface condition of the work pieces is influenced by the time of heating, the temperature level maintained, and the atmosphere surrounding the material. By using the proper atmosphere in the working chamber, a clean scale-free surface is obtained.

Described above is the preferred embodiment of the product layer forming apparatus 37, annealing furnace 43 and product layer discharging apparatus 127. Other embodiments of the annealing furnace are possible. With different annealing furnaces, the product layer forming apparatus and the product layer discharging apparatus will be arranged accordingly so that elongated metal product may be charged into and discharged from the annealing furnace. As previously mentioned, different annealing furnaces will have different entrances and exits thus requiring different configurations of the product layer forming apparatus and the product layer discharging apparatus.

Figure 6:
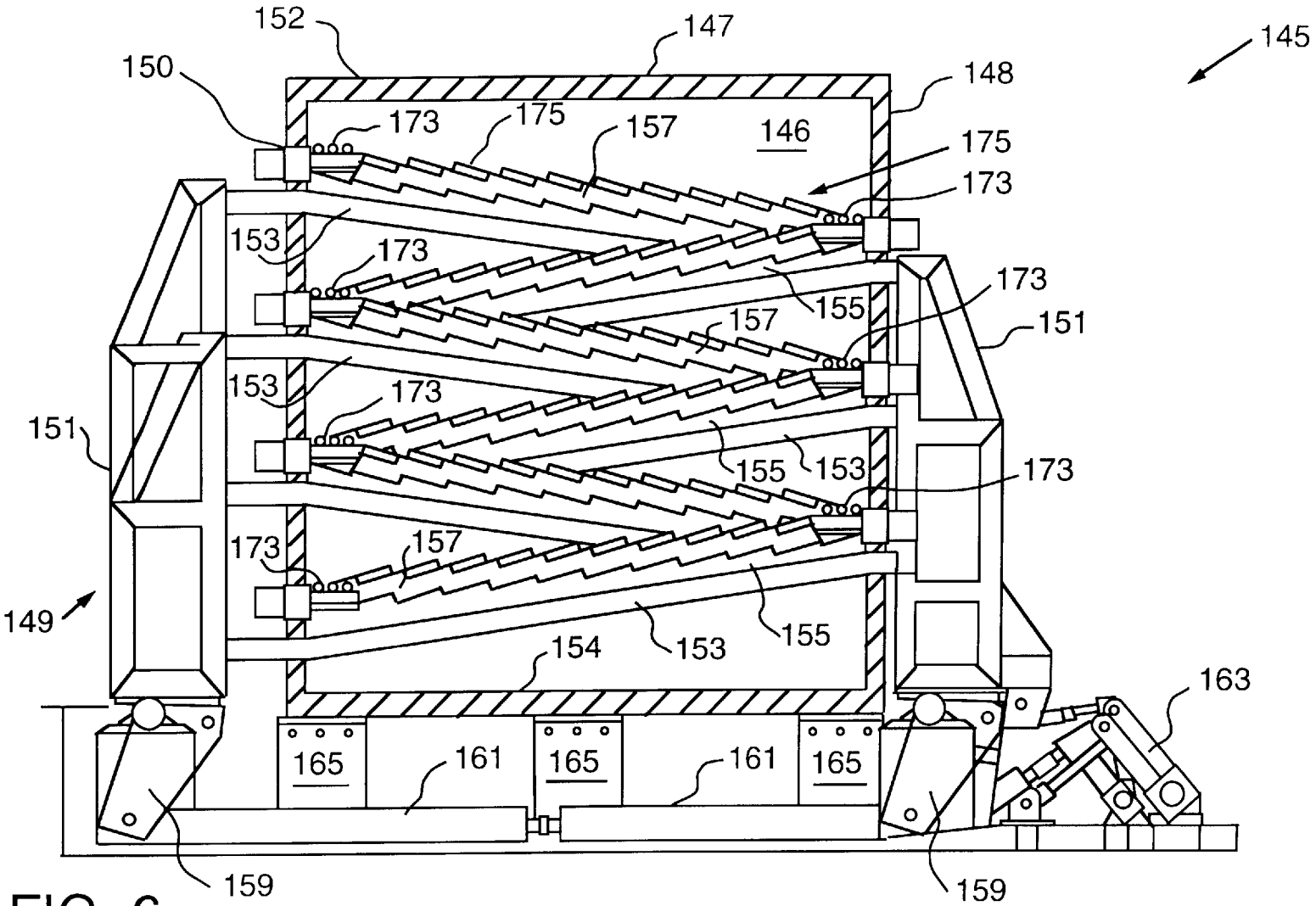
FIG. 6 is schematic cross-sectional view of an annealing furnace of the present invention with a two directional product conveyor arranged in a zig-zag path.
Figure 7:
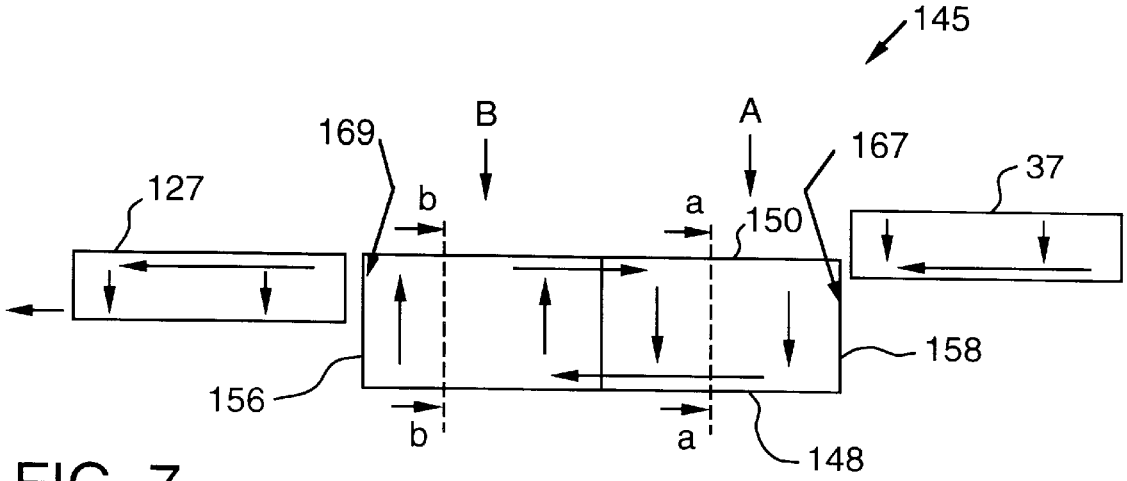
FIG. 7 is a schematic top-down view of the annealing furnace of FIG. 6.

FIG. 6 is a schematic cross-sectional view of a annealing furnace 145 of a second embodiment of the present invention. Annealing furnace 145 of the second embodiment is similar to annealing furnace 43 shown in FIG. 4. The main difference is that annealing furnace 145 has a coordinated transportation device 149 (FIG.6) arranged in a zig-zag path and divided between two chambers (FIGS. 7 and 8). Like annealing furnace 43, annealing furnace 145 is located directly downstream product layer forming apparatus 37 and directly upstream from product layer discharging apparatus 127 (FIG. 7).

Referring to FIG. 6, annealing furnace 145 has an interior cavity 146 formed by opposing sidewalls 148 and 150, a roof 152, a floor 154 a back wall 156 (FIG. 7) and a front wall 158 (FIG. 7). Annealing furnace 145 has an insulated housing 147 made of insulated brick like the insulated brick 101 of annealing furnace 43.

Annealing furnace 145 has a coordinated transportation device 149 which includes a plurality of movable support means 151 in sets of opposing pairs, two of which are shown in FIG. 6; a plurality of connection beams 153 connecting the plurality of movable support means 151; a plurality of layer moving surfaces 155 arranged in a zig-zag path and connected to the connection beams 153; a plurality of layer support surfaces 157 arranged in a zig-zag path and fixed with respect to the annealing furnace 145; an intermediate device 159 connected to the base of each of the plurality of movable support means 151; at least one actuating link 161 connecting intermediate devices 159 under a pair of the plurality of movable support means 151 and at least one drive means 163 connected to intermediate device 151 on at least one side of the annealing furnace 145. Annealing furnace 145 is supported by a plurality of foundation members 165. The operation of the plurality of movable support means 151, the at least one actuating link 161, intermediate devices 159 and at least one drive means 163 is the same as that described for annealing furnace 43 (FIG. 4).

Referring to FIG. 7, annealing furnace 145 has an entrance 167 located approximate product layer forming apparatus 37 and an exit 169 located approximate product layer discharging apparatus 127. Annealing furnace 145 is divided into a first chamber A and a second chamber B.

Annealing furnace 145 can be understood by FIGS. 6–8 taken together. FIG. 6 is a schematic cross-sectional view of along the length of annealing furnace 145 illustrating the coordinated transportation device 149 arranged in a zig-zag path. FIG. 7 shows that annealing furnace 145 is divided into the first chamber A and the second chamber B adjacent to each other. The arrows in FIG. 7 show the product layer flow path from product layer forming apparatus 37 through annealing furnace 145 and out product layer discharging apparatus 127.

Figure 8A:
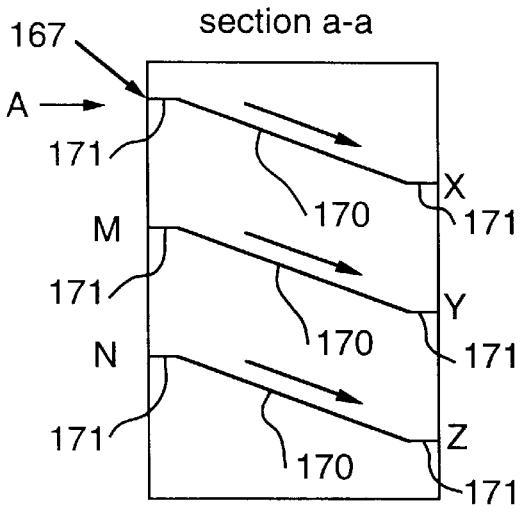
FIG. 8*a* is a schematic cross-sectional view taken along line a—a of FIG. 7.
Figure 8B:
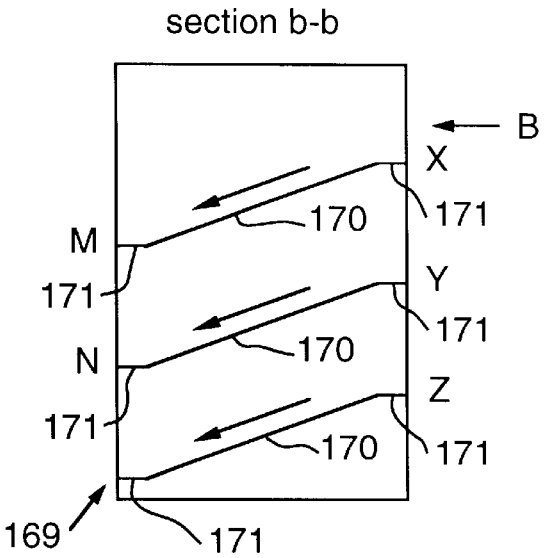
FIG. 8*b* is a schematic cross-sectional view taken along line b—b of FIG. 7.

FIG. 8*a* is a schematic cross-situational view of first chamber A taken along lines a—a and FIG. 8*b* is a schematic cross-sectional view of second chamber B taken along lines b—b. First chamber A and second chamber B are connected so that the location indicated by letters M, N, X, Y, and Z of first chamber A match location indicated by the same letters on second chamber B. Line 170 in FIGS. 8*a* and 8*b* represent each of the plurality of layer moving surfaces 155 and plurality of layer support surfaces 157 as shown in FIG. 6. The arrows indicate the direction of product layer flow through first chamber A and second chamber B. Horizontal lines 171 of FIGS. 8*a* and 8*b* correspond to roller tables 173 on FIG. 6.

A layer 175 of metal product shown in FIG. 6 enters the first chamber A of annealing furnace 145 at entrance 167. Layer 175 first contacts a first roller table 173 which rotates to transport the layer 175 into annealing furnace 145. Layer 175 is first moved to the first of a plurality of layer moving surfaces 155 and the first of the layer support surfaces 157 of coordinated transportation device 149. Layer 175 moves down along the inclined surface, indicated by line 170 of FIG. 8*a*, created by the first of a plurality of layer moving surfaces 155 and the first of the layer support surfaces 157 from a location approximate entrance 167 to a location X. At the location X layer 175 is moved onto a second roller table 173.

The second roller table 173 is substantially horizontal in the preferred embodiment is cylindrical and rotatable such that it can advance layer 175 longitudinally onto a corresponding third roller table 173 in second chamber B at location X. From the third roller table 173 at location X in second chamber B, layer 175 moves down along the inclined surface, indicated by line 170 of FIG. 8*b*, created by the second of a plurality of layer moving surfaces 155 and the second of the layer support surfaces 157 from a location X to a location M. At location M layer 175 moves onto a fourth roller table 173. The fourth roller table 173 is substantially horizontal in the preferred embodiment is cylindrical and rotatable such that it can advance layer 175 longitudinally onto a corresponding fifth roller table 173 in first chamber A at location M. Layer 175 is transported back and fourth through first chamber A and second chamber B until it is discharged through exit 169. Layer 175 travels in one direction in first chamber A and travels in the opposite direction in second chamber B.

Layer 175 can achieve a long residence time in annealing furnace 145 because of the arrangement of the product transportation device 149. The long residence time is advantageous in some heat treating methods.

Figure 9:
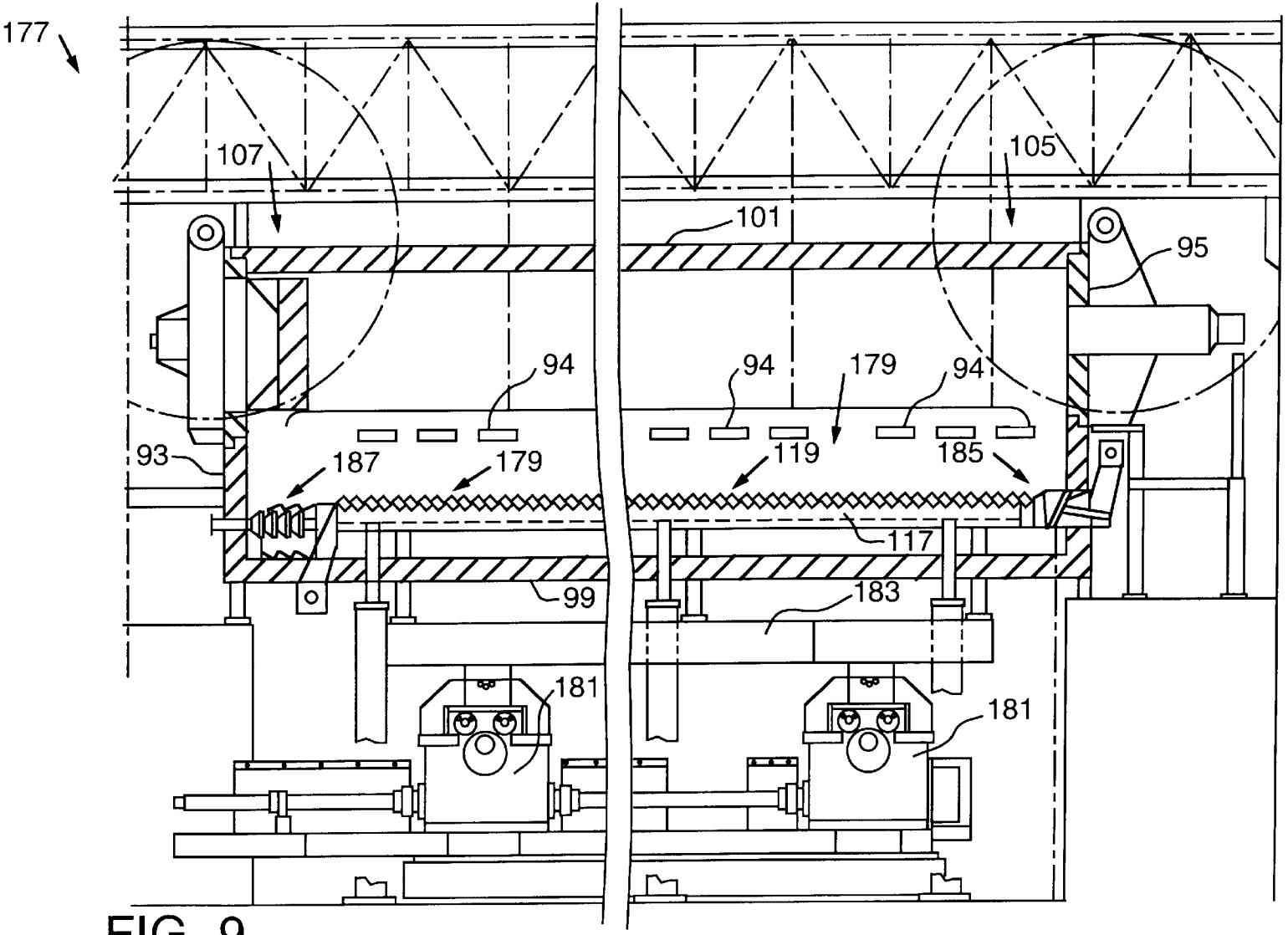
FIG. 9 is a schematic cross-sectional view of a one-level annealing furnace of the present invention with one level.

FIG. 9 is a schematic cross-sectional view of an annealing furnace 177 of a third embodiment of the present invention. Annealing furnace 177 has a product layer transportation device 179 of a single level. Annealing furnace 177 is similar to annealing furnace 43 of FIG. 4, with similar reference numbers referring to corresponding parts. Product layer transportation device 179 has drive means 181 connected to platform 183 for moving the plurality of layer support surfaces 119.

In annealing furnace 177, the product layer forming apparatus 185 and product layer discharging apparatus 187 are located inside annealing furnace 177 since it is not necessary to use the systems having more than one level. Product layer forming apparatus 185 is preferably an indexing transportation device that can form layers of product from individual metal product loaded into annealing furnace at location approximate product layer forming apparatus 185. Product layer discharging apparatus 187 is preferably a transportation device for breaking up product layers transported through annealing furnace 177.

Figure 10:
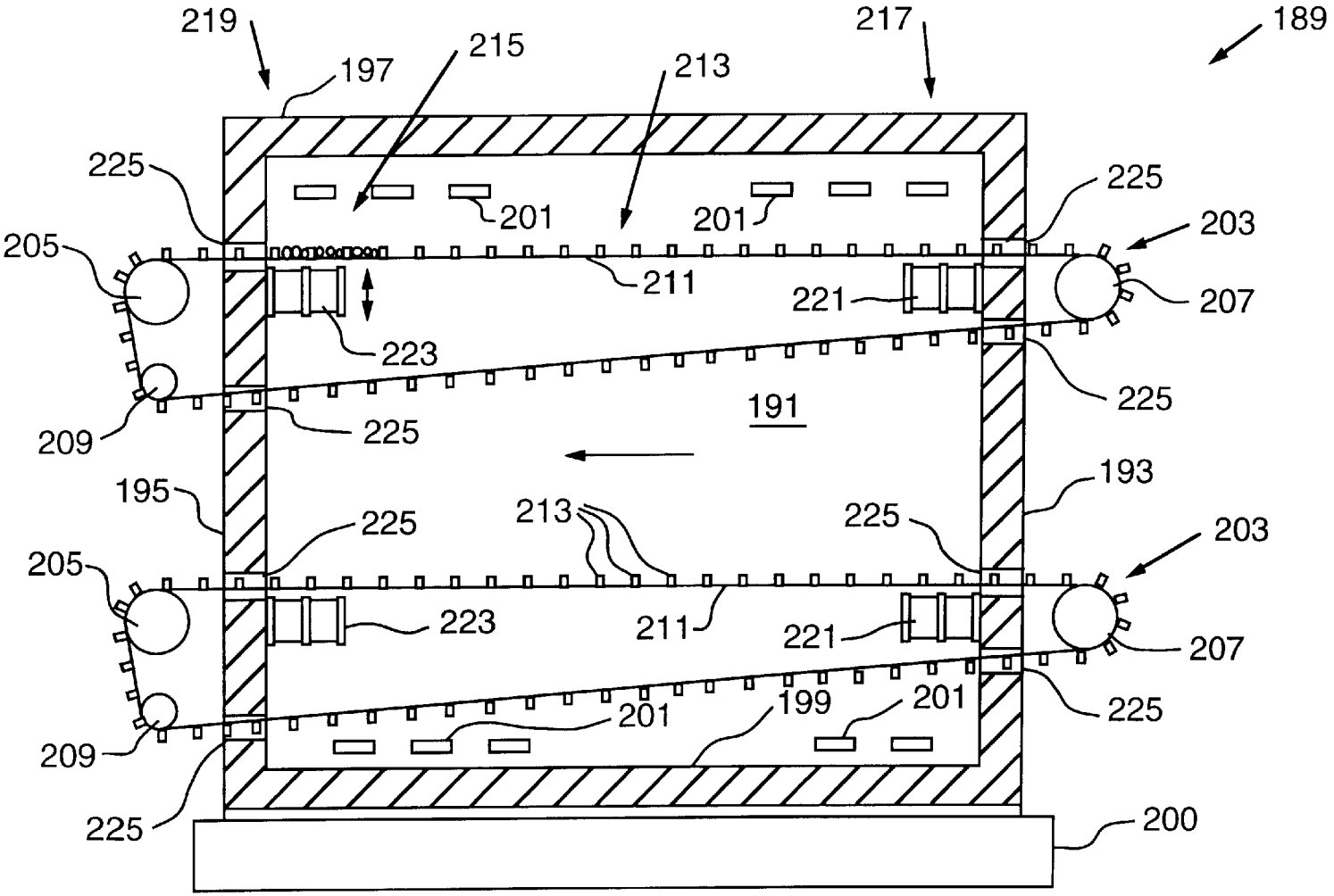
FIG. 10 is a schematic cross-sectional view of an annealing furnace of the present invention utilizing chain conveyors.

FIG. 10 illustrates a cross sectional view of an annealing furnace 189 of a fourth embodiment of the present invention. The annealing furnace 189 of the third embodiment is be coordinated with product layer forming apparatus 37 (FIG. 3) and a product layer discharging apparatus 127 (FIG. 5). Annealing furnace 189 has an interior cavity 191 formed by opposing side walls 193 and 195, a roof 197 a floor 199, a front wall (not shown) and a back wall (not shown). All walls and the roof 197 and floor 199 are made of insulated material in order to retain heat in the interior cavity 191 of annealing furnace 189. Annealing furnace 189 is preferably located on a foundation 200. Also located in the interior cavity 191 of annealing furnace 189 is the heating means 201 which may be any conventional furnace heating means.

Annealing furnace 189 includes a series of substantially horizontal endless belt conveyors 203 stacked vertically from the floor 199 to the roof 197 of annealing furnace 189. Each endless belt conveyor 203 includes a drive shaft 205, an idler shaft 207 and a tension shaft 209. Each shaft has a plurality of sprockets (not shown) for gripping and endless link conveyor chain 211 strung between the drive shaft 205, the idler shaft 207 and the tension shaft 209. Each endless link conveyor chain 211 is provided with a plurality of outwardly extending flanges 213 which are suitably spaced and transversely aligned to receive a plurality of individual metal products 215.

Annealing furnace 189 has two endless belt conveyors 203 and therefore two levels for product transportation through annealing furnace 189. Annealing furnace 189 has an entrance side 217 and an exit side 219. Layers of metal product enter annealing furnace 189 from the product layer forming apparatus at entrance side 217 and are transported by the endless link conveyors 203 in the direction of the arrow to exit side 219. Layers of metal product enter annealing furnace 189 by the horizontal loading devices 221 which are preferably cylindrical and rotatable to longitudinally load layers of metal product into annealing furnace 189. Similarly, layers of metal product exit by the horizontal discharging devices 223 which are preferably cylindrical and rotatable to longitudinally discharge layers of metal product to product layer discharging apparatus 127 (FIG. 5).

Annealing furnace 189 is designed so that the side walls 193 and 195 and front wall and back wall support the shafts of the endless link conveyors 203. Further, a plurality of openings 225 exists in side walls 193 and 195 for the passage of the endless link conveyor chain 203. The opening may have a seal to prevent thermal transfer from the interior cavity 191 to the exterior of annealing furnace 189.

While there has been illustrated and described several embodiments of the present invention, it will be apparent that various changes and modifications thereof will occur to those skilled in the art. It is intended in the appended claims to cover all such changes and modifications that fall within the true spirit and scope of the present invention.

I claim:

1. A furnace for annealing metal product comprising:

a. a layer forming apparatus suitable to create layers of metal product;

b. an insulated housing having an interior cavity formed by a roof, a floor, opposing side walls extending the annealing furnace length, opposing side walls extending the annealing furnace width, said insulated housing also having an entrance for introducing metal product and exit for discharging metal product;

c. a heating means in the interior cavity for heat treating metal product;

d. transportation device suitable to convey the metal product in form of layers from the chamber entrance to its exit, whereas to guarantee a stay time inside said furnace suitable for obtaining a required heat treatment;

e. a discharging apparatus suitable to break up the product layers.

2. The furnace according to claim 1, wherein:

a. said transportation device comprises two or more devices arranged substantially horizontal and parallel with respect to each other;

b. said layers forming apparatus is positioned upstream said furnace and said layers forming apparatus consists of an individual product transportation device which is followed by a product layer forming device which is followed by a product layer transportation device, which is followed by a product layer lifting device;

c. said discharging apparatus is positioned downstream said furnace and said discharging apparatus consists of a vertical product layer lifting device followed by a horizontal product layer transportation device which is followed by an individual metal transportation device.

3. The furnace according to claim 1, wherein said transportation device is divided into two parts, the first of transports layers in one direction, and the second transports layers in the opposite direction, said parts of the transportation device are made up of inclined surfaces and roller tables so that the end of one surface of the first part is connected to the beginning of the second surface of the second part via roller tables, thereby achieving a continuous vertical and horizontal handling of the layers from the furnace entrance to it exit.

4. The furnace according to claims 1 or 2 or 3, wherein the transport devices consist of:

a. a plurality of support surfaces and moving surfaces disposed in the interior cavity of the annealing furnace with a longitudinal axis of each of said support surfaces and said moving surfaces parallel to a feed direction of metal product;

b. the plurality of support surfaces having a face for supporting metal product and fixed with respect to the insulated housing;

c. each of said plurality of moving surfaces having a face for engaging and moving metal product and secured at each opposing end to one of at least two movable support means longitudinally disposed along the exterior of the length of the annealing furnace;

d. at least two movable support means arranged in directly opposing pairs and movable by intermediate devices disposed at the base of said movable support means, and e. a drive means connected to the intermediate devices for impairing motion to said intermediate devices, said intermediate devices transform the motion received by the drive means in a coordinated motion of lifting, translating and subsequent lowering of the movable support means then transmitted to the movable tables, thus allowing for a step-to-step forward movement of the layers inside the furnace.

5. A furnace according to claims 1 or 2 or 3, wherein the transport devices consist of endless link chain conveyors.

* * * * *